US006241380B1

(12) United States Patent
Bornemann et al.

(10) Patent No.: US 6,241,380 B1
(45) Date of Patent: Jun. 5, 2001

(54) MIXER FOR GRANULAR MATERIAL

(75) Inventors: Hans-Joachim Bornemann, Vellmar; Andre Greiling, Borken 1, both of (DE)

(73) Assignee: Thyssen Henschel GmbH (DE)

( * ) Notice: Subject to any disclaimer, the term of this patent is extended or adjusted under 35 U.S.C. 154(b) by 0 days.

(21) Appl. No.: 09/032,662

(22) Filed: Feb. 27, 1998

(30) Foreign Application Priority Data

Feb. 28, 1997 (DE) ..... 197 08 075

(51) Int. Cl.[7] ..... B01F 11/00
(52) U.S. Cl. ..... 366/217; 366/232; 366/224
(58) Field of Search ..... 366/213, 216, 366/217, 218, 232, 209, 208, 219, 220, 224, 197, 245

(56) References Cited

U.S. PATENT DOCUMENTS

| | | | | |
|---|---|---|---|---|
| 3,999,742 | * | 12/1976 | Heyraud | 366/213 |
| 4,173,925 | | 11/1979 | Leon . | |
| 4,368,985 | | 1/1983 | Churland . | |
| 4,372,686 | * | 2/1983 | Herfeld | 366/232 |
| 4,676,658 | * | 6/1987 | Herfeld | 366/213 |
| 4,698,917 | * | 10/1987 | Debolini | 366/224 |
| 4,775,242 | * | 10/1988 | Bohle | 366/216 |
| 4,781,468 | * | 11/1988 | Herfeld | 366/213 |
| 5,054,933 | * | 10/1991 | Dersken et al. | 366/213 |
| 5,123,747 | | 6/1992 | Derksen . | |

FOREIGN PATENT DOCUMENTS

| | | |
|---|---|---|
| 2110047 | 9/1972 | (DE) . |
| 2303344 | 3/1974 | (DE) . |
| 3433674 | 3/1986 | (DE) . |
| 0269799 | 6/1988 | (EP) . |
| 0269799 | 8/1988 | (EP) . |
| 8204407 | 12/1982 | (WO) . |

* cited by examiner

*Primary Examiner*—Tony G. Soohoo
(74) *Attorney, Agent, or Firm*—Robert W. Becker & Associates

(57) ABSTRACT

A mixer for granular materials has a mixing container consisting of a first mixing container portion and a second mixing container portion detachably connected to one another. The mixing container has a longitudinal axis and a transverse axis extending perpendicularly to the longitudinal axis. A support frame is provided in which the mixing container is supported so as to be pivotable about the transverse axis and rotatable about the longitudinal axis. The mixing container has a first position in which mixing is performed and in which the second mixing container portion is positioned above the first mixing container portion. The mixing container has a second position in which the second container portion, after completion of mixing, contains the mixed material and is detachable from the first mixing container portion.

12 Claims, 11 Drawing Sheets

MIXER FOR GRANULAR MATERIAL

BACKGROUND OF THE INVENTION

The present invention relates to a mixer for any granular or particulate material of any granule or particle size, such a powders, grit-size material etc, which optionally may have liquids added thereto, as well as pastes, especially PVC paste. The mixer comprises a first mixing container portion that is pivotable about an axis positioned at an angle to the longitudinal axis of the mixing container portion and a second mixing container portion in which the mixed product, after separation from the first mixing container portion, is located for further use. The present invention also relates to a method for performing a mixing process in the inventive mixer.

Mixers having a mixing container consisting of two mixing container portions are known. In such mixers, the bottom mixing container portion into which the material to be mixed has been filled is connected to a second mixing container portion having a mixing tool and, subsequently, the mixing container is rotated by 180° relative to a horizontal axis so that the mixing tool is now at the bottom. In this upside down position, in which the mixing tool rotates about a vertical rotary axis, the mixing process is performed. After completion of the mixing process, the mixing container is again rotated about the horizontal axis into its initial position in which the mixing container portion containing the mixed material can be separated from the other parts of the mixer.

From European Patent 0 269 799 B1 a mixing device is known in which a mixing container is provided comprised of two bowl-shaped mixing container portions that are connectable to one another. The mixer comprises a stationary holder at which one of the mixing container portions of the mixing container is rotatably supported so as to be pivotable about a horizontal support axis and wherein the second container portion has a mixing tool whose shaft in the mixing position is vertical.

In such mixers the mixing tool must be rotated at a high rpm in order to ensure that the material is sufficiently mixed. The material to be mixed is forced upwardly at the inner walls of the mixing container. This causes heating of the material to be mixed. This undesirable temperature increase is counteracted by cooling measures, for example, cooling of a double wall outer mantle of the mixing container. This requires a considerable additional expenditure, and may result in an undesirable change of the product properties because heating of the mixed material during mixing cannot be completely avoided.

It is therefore an object of the present invention to improve a mixer of the aforementioned kind such that an excellent mixing of the material can be performed in a short period of time without causing temperature-based undesirable changes of the material properties.

SUMMARY OF THE INVENTION

The mixer for granular materials according to the present invention is primarily characterized by:

- a mixing container comprised of a first mixing container portion and a second mixing container portion detachably connected to one another;
- the mixing container having a longitudinal axis and a transverse axis extending perpendicularly to the longitudinal axis;
- a support frame in which the mixing container is supported so as to be pivotable about the transverse axis and rotatable about the longitudinal axis;

- the mixing container having a first position in which mixing is performed and the second mixing container portion is positioned above the first mixing container portion;
- the mixing container having a second position in which the second mixing container portion, after completion of mixing, contains the mixed material and is detachable from the first mixing container portion.

Advantageously, the mixer further comprises a pivot bracket comprising a rotary bearing. The mixing container is supported by the rotary bearing in the pivot bracket for rotation about the longitudinal axis. A shaft is fixedly connected to the pivot bracket and rotatably supported in the support frame, wherein the mixing container is connected to the shaft.

Advantageously, the rotary bearing is a roller bearing.

Preferably, the first mixing container portion has a rotating mixing tool comprising radially extending mixing blades, wherein the mixing blades end in direct vicinity of a container wall of a first mixing container portion.

Advantageously, the mixing blades, in the direction of rotation of the mixing tool, are downwardly and forwardly slanted at least in a radially outer portion of the mixing tool.

Preferably, the first mixing container portion has a rotating mixing tool comprising mixing blades spaced from a container wall of the mixing container portion. The mixing blades, in a direction of rotation of the mixing tool, are preferably downwardly and forwardly slanted at least in a radially outer portion of the mixing tool.

Preferably, the first mixing container portion comprises a cover closing of the interior of first mixing container portion for enclosing in the interior a granular cleaning substance.

The present invention also relates to a method for mixing granular material, wherein the method is primarily characterized by the steps of:

- providing a mixing container comprised of a first mixing container portion and a second mixing container portion detachably connected to one another, wherein the mixing container has a longitudinal axis and a transverse axis extending perpendicularly to the longitudinal axis;
- supporting the mixing container on a support frame such that the mixing container is pivotable above the transverse axis and rotatable about the longitudinal axis;
- filling a granular material into the second mixing container portion and connecting the second mixing container portion to the first mixing container portion; pivoting the mixing container into a first position in which the longitudinal axis is slanted relative to a vertical position and in which the second mixing container portion is positioned above the first mixing container portion;
- rotating the mixing container positioned in the first position for mixing the granular material;
- after completion of mixing, positioning the mixing container in a second position such that the second mixing container portion contains the mixed material and detaching the second mixing container portion from the first mixing container portion.

The invention also relates to a method for mixing granular material characterized by the steps of:

- providing a mixing container comprised of the first mixing container portion and a second mixing container portion detachably connected to one another, wherein the mixing container has a longitudinal axis and a transverse axis extending perpendicularly to the longitudinal axis;

equipping the first mixing container portion with a mixing tool comprising radially extending mixing blades ending in direct vicinity of the container wall of the first mixing container portion;

supporting the mixing container on a support frame such that the mixing container is pivotable about the transverse axis and rotatable about the longitudinal axis;

filling a granular material into the second mixing container portion and connection the second mixing container portion to the first mixing container portion;

pivoting the mixing container into a first position in which the longitudinal axis is vertical and in which the second mixing container portion is positioned above the first mixing container portion;

rotating the mixing container positioned in the first position and the mixing tool for mixing the granular material;

after completion of mixing, positioning the mixing container in a second position in such that the second container portion contains the mixed material and detaching the second mixing container portion from the first mixing container portion.

Preferably, in the step of rotating, the mixing container and the mixing tool are rotated in opposite directions.

The mixing tool is preferably rotated at a higher speed than the mixing container.

According to the present invention, the mixing container comprised of a first and a second mixing container portion is supported at a support frame such that is rotatable about its longitudinal axis and is pivotable from a mixing position, in which the second mixing container portion is above the first mixing container portion, into a second position, in which the second container portion containing the mixed product can be separated (detached) from the first mixing container portion.

In the inventive design the inner container wall causes the movement of the material to be mixed so that, in comparison to an agitating mixer, a relatively large slowly rotating surface is provided for entraining the material to be mixed. This results in a much more intensive mixing of the material. The heat development within the material to be mixed is negligibly small so that cooling of the mixing container is no longer needed.

In a preferred embodiment of the invention the support frame has connected thereto a shaft which is rotatable within the support frame and fixedly connected to a pivot bracket. The pivot bracket comprises a rotary bearing in which the mixing container, comprised of the two mixing container portions, is guided so as to be rotatable about its longitudinal axis.

A suitable rotary bearing can be in the form of a ball bearing or roller bearing. The forces and moments resulting from the rotation of the mixing container can be safely received by such a bearing and by the pivot bracket.

In another embodiment of the invention the first mixing container portion comprises a rotating mixing tool having mixing blades which extend substantially radially outwardly into direct vicinity of the container wall of the first mixing container portion. The term mixing tool includes tools for mixing and/or dispersion.

In the alternative, the first mixing container portion may have a rotary (rotating) mixing or dispersion tool having mixing blades that are spaced from the container wall of the first mixing container portion.

When using such mixing or dispersion tools, the movement of the material to be mixed resulting from the container wall has a further movement superimposed thereon which results from the rotation of the mixing or dispersion tool. Since the superimposed gravitational forces and centrifigal forces act in different directions, in a very short period of time a very homogeneous mixed material will result.

When the mixing blades of the mixing or dispersion tool are at least in their radially outer portions slanted forwardly and downwardly in the direction of rotation, a pressure difference will result between the top and the bottom side of the mixing blade which causes turbulence without significant increase of friction of the particles of the material to be mixed and favors a fast mixing of the material.

For cleaning the mixer, the first mixing container portion can be provided with a cover that together with the first mixing container portion provides a closed interior for receiving a flowable or granular cleaning substance. If it is desired to also clean the second mixing container portion, a cover is not required. In such a case, the cleaning of the mixing container is performed in a position in which the longitudinal axis of the container is substantially horizontally positioned.

For an expedient mixing process the mixing container is pivoted into a mixing position and is rotated in this mixing position. The longitudinal axis of the container is slanted relative to a vertical position in this mixing position. Such a method can be modified so as to provide an especially efficient mixing of the material by slanting the mixing container with its longitudinal axis relative to a vertical position by 10 to 35°.

In another preferred method, the mixing container is pivoted into a mixing position in which the longitudinal axis of the container coincides with a vertical position and in this position the mixing container is rotated. In addition, in the mixing container has a mixing tool that is also rotated. It has mixing blades which extend into the direct vicinity of the container wall of the mixing container.

Another expedient method includes the steps of rotating the mixing container and the mixing or dispersion tool in opposite rotary directions. The resulting increase of relative movement of the colliding particles results in improved distribution, (dispersion) optionally also in a size reduction and mixing of the material.

The speed of the mixing container can be relatively small in comparison to the speed of the mixing or dispersion tool by taking advantage of the effect of gravity, and this results in prevention of undesirable heating of the material to be mixed. An especially short mixing time can be achieved when the speed of the mixing tool is greater by 40 to 80 times than the speed of the mixing container.

Such a method can be modified with respect to an especially efficient mixing of the material by performing rotation of the mixing container when it is positioned with its longitudinal axis pivoted by about to 10° to 70° relative to the vertical position.

When the mixer is provided with a dispersion tool, it is possible, by rotating the mixing container and the dispersion tool in opposite directions, to increase the relative velocity of the colliding particles so that an accelerated distribution, optionally size reduction and mixing of the material is achieved.

The speed of the mixing container, when taking advantage of the effect of gravity, can be small in comparison to the speed of the dispersion tool which avoids undesirable heating of the material to be mixed. An especially favorable result can be achieved when the speed of the dispersion tool is by 40 to 100 times greater than the speed of the mixing container.

BRIEF DESCRIPTION OF THE DRAWINGS

The object and advantages of the present invention will appear more clearly from the following specification and conjunction with the accompanying drawings, in which.

DESCRIPTION OF THE PREFERRED EMBODIMENTS

The present invention will now be described in detail with the aid of several specific embodiments utilizing FIGS. 1 through 8.

Figure 1:
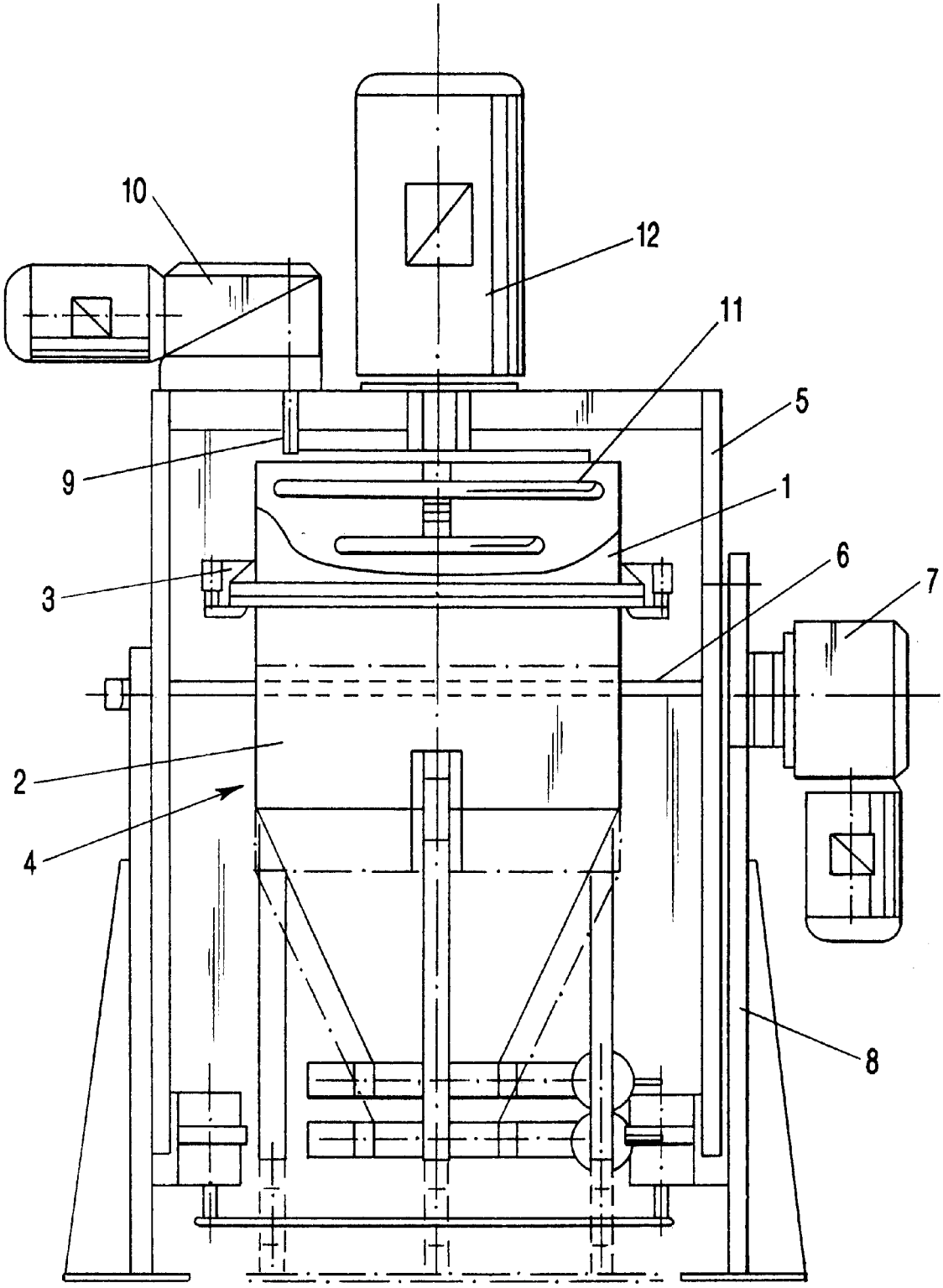
FIG. 1 shows a side view of the mixer.

The mixer represented in FIG. 1 comprises a cylindrical mixing container portion 1 and a mixing container portion 2 having a basic cylindrical portion and a truncated cone-shaped portion attached thereto. The two container portions are connected by a clamping device 3 to form the mixing container 4. The clamping device 3 can be pneumatically actuated rotary closure members.

The mixing container portion 1 is connected to the pivot bracket 5 which is connected to a shaft 6 in a fixed manner. A pivot drive 7 engages the shaft 6 for pivoting the mixing container 4 relative to a support frame 8 in which the shaft 6 is rotatably supported.

Figure 4:
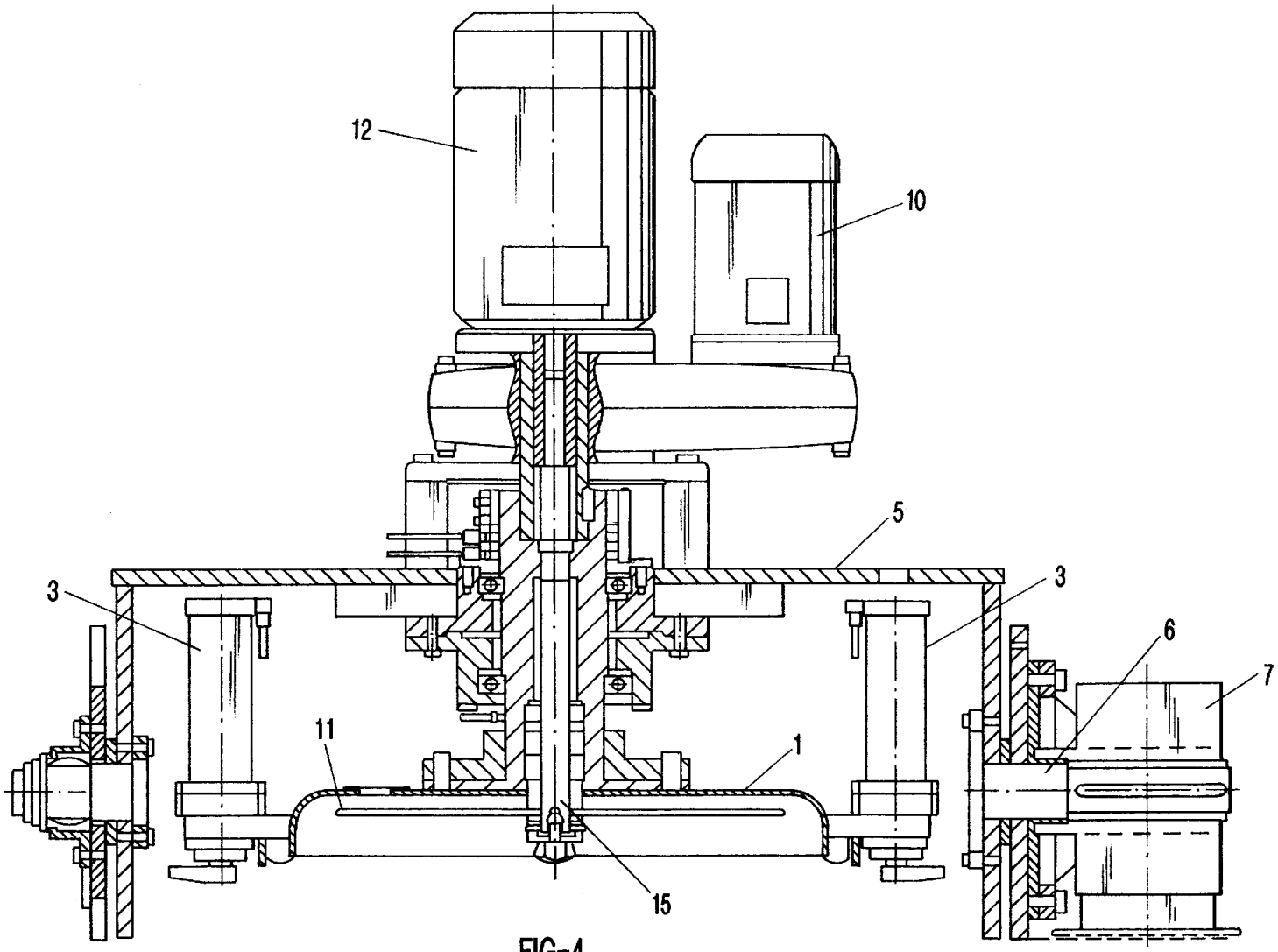
FIG. 4 shows a constructive design of the drive of the mixing container for rotation about the longitudinal axis.
Figure 5:
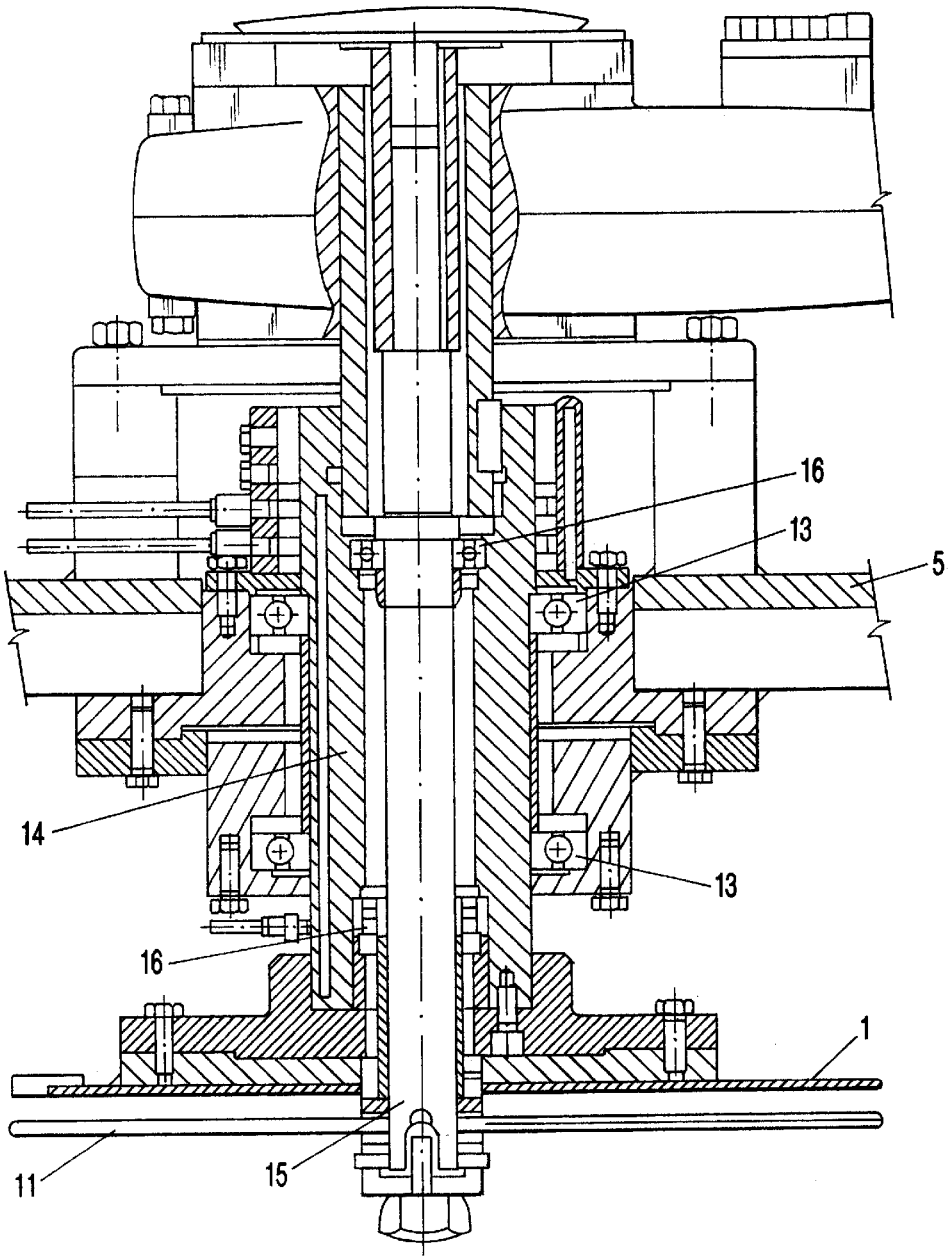
FIG. 5 shows a detail of FIG. 4.
Figure 6A:
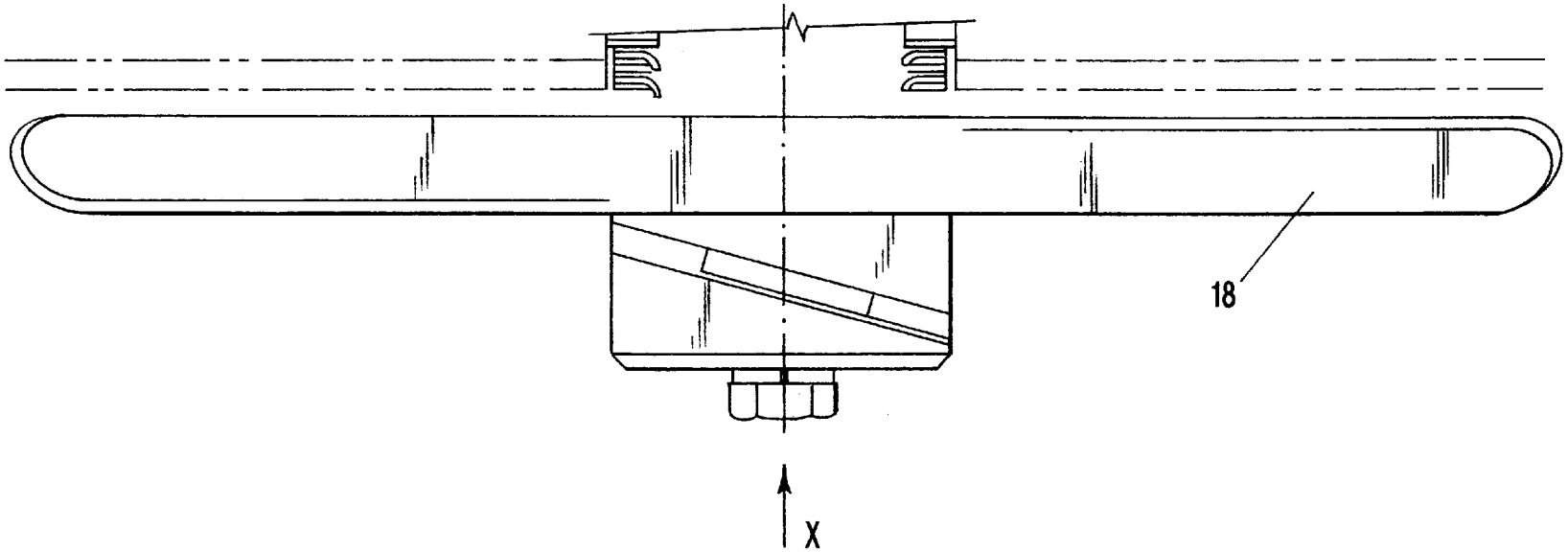
FIGS. 6*a* through 6*c* shows a mixing tool with crossed mixing blades.
Figure 6B:
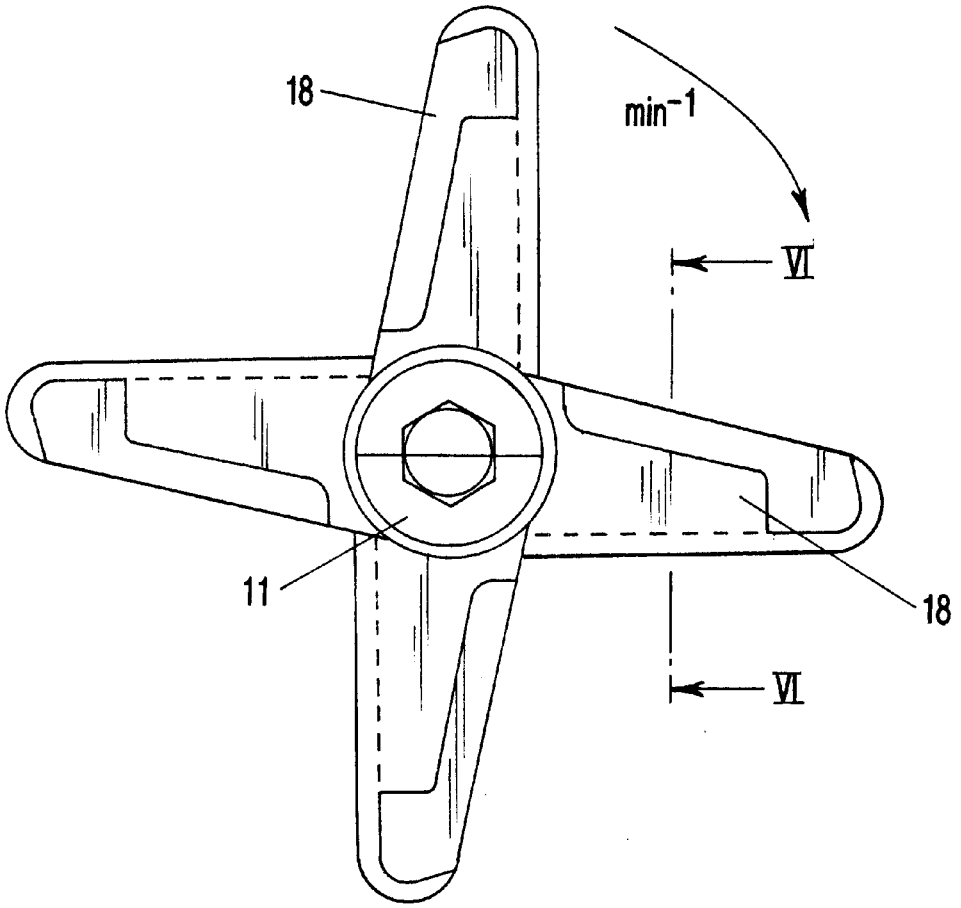
Figure 6C:
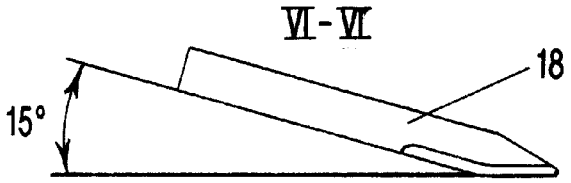

A rotary drive 10 is provided that engages with friction wheel 9 the mixing container portion 1 and rotates the mixing container 4 about its longitudinal axis. The mixing container 4 can also be driven by a hollow shaft 14 supported in ball bearings 13 within the pivot bracket 5. This hollow shaft is driven by the rotary drive 10 as shown in FIG. 4. Within the hollow space of the hollow shaft 14 a shaft 15 guided in bearing 16 is provided and rotatable relative to the hollow shaft 14. The shaft 15 supports the mixing or dispersion tool 11 arranged within the first mixing container portion 1 and driven by a motor 12 in rotation. The relative arrangement of hollow shaft 14 and shaft 15 can be seen in the representation of FIG. 5. The mixing or dispersion tool (11) can have different designs. A basic design is that the mixing blades 18 have a slant relative to the horizontal position so that between the upper and lower edges of the mixing blades 18 a pressure difference results which causes an intensive mixing of the material to be mixed. An embodiment of this kind is shown in FIG. 6.

Figure 7A:
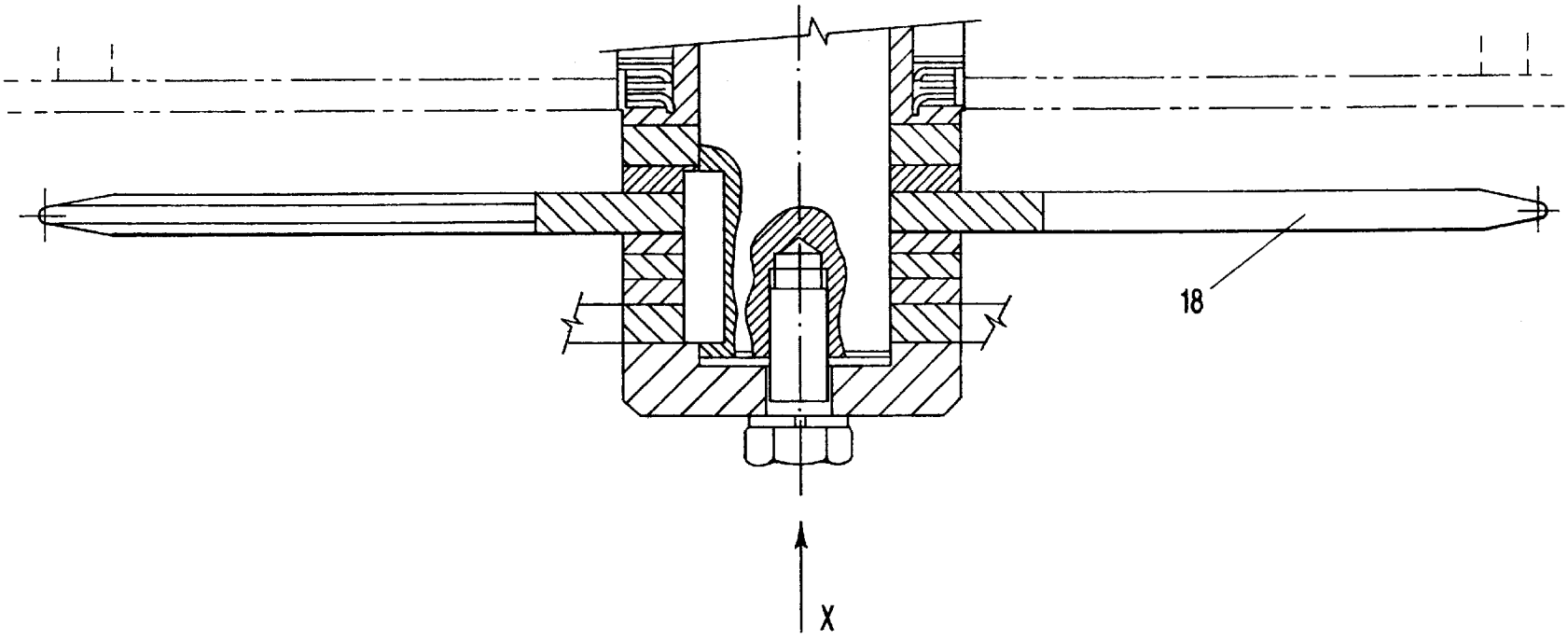
FIGS. 7*a* through 7*b* show a mixing tool with crescent or sickle-shaped mixing blades.
Figure 7B:
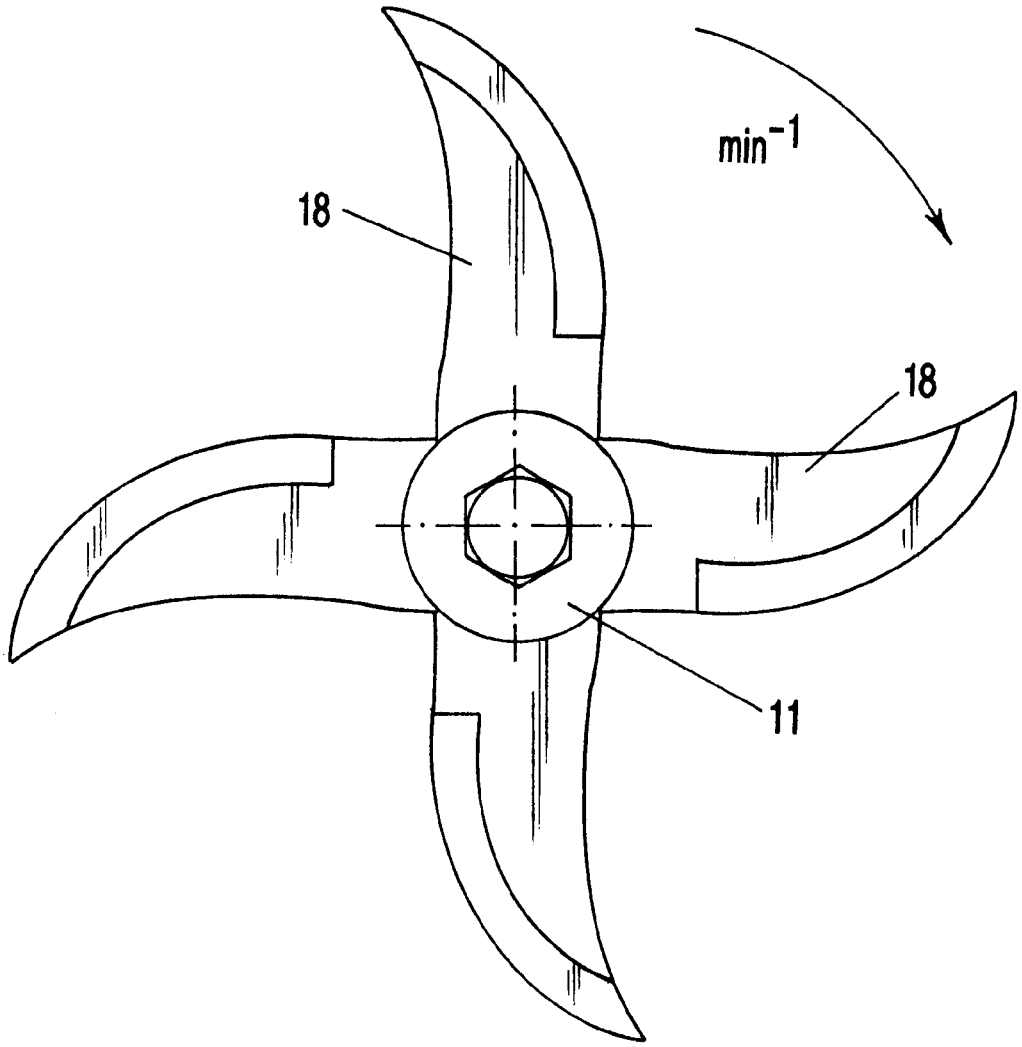
Figure 8A:
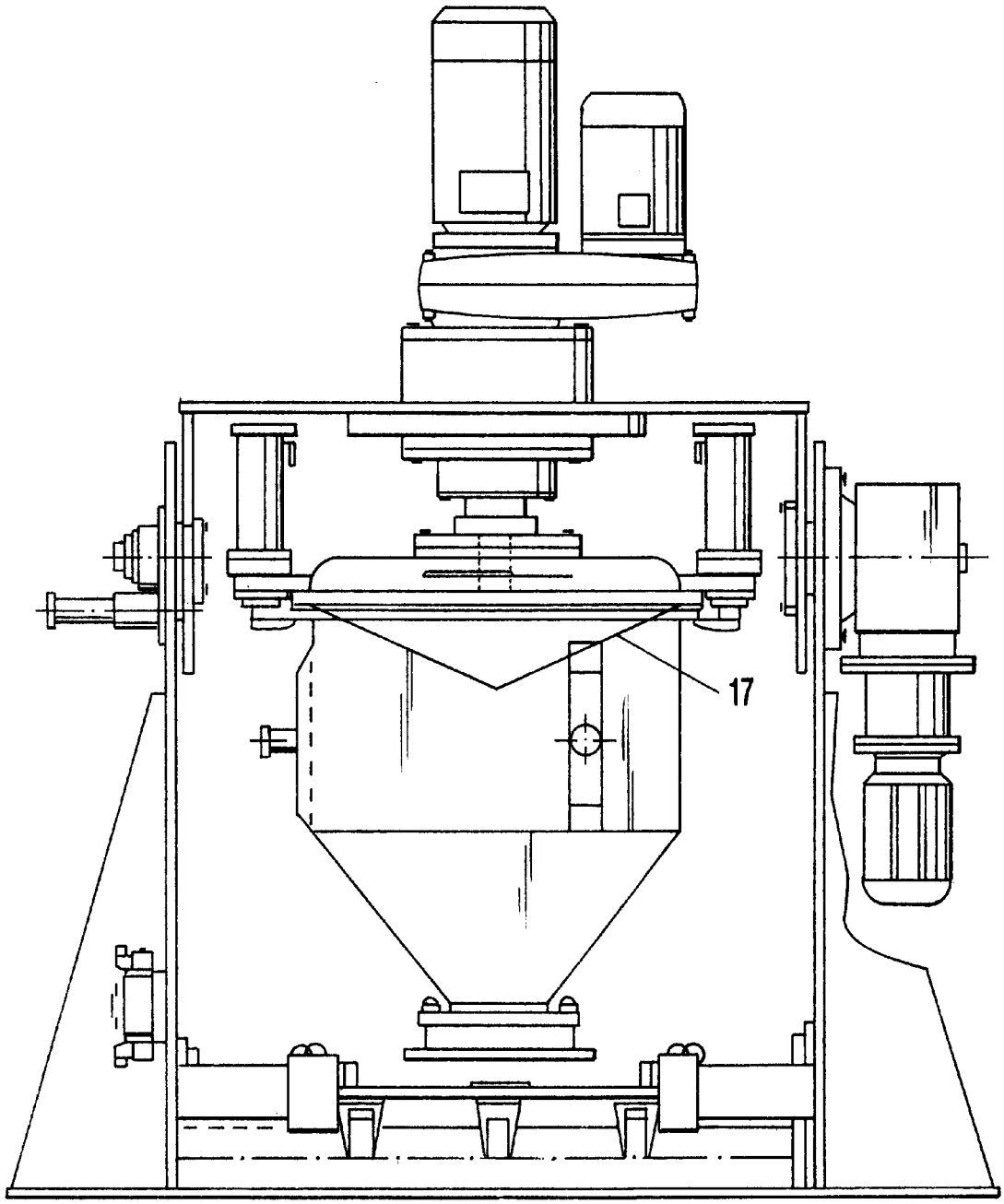
FIGS. 8*a* through *d* show a cleaning device.
Figure 8B:
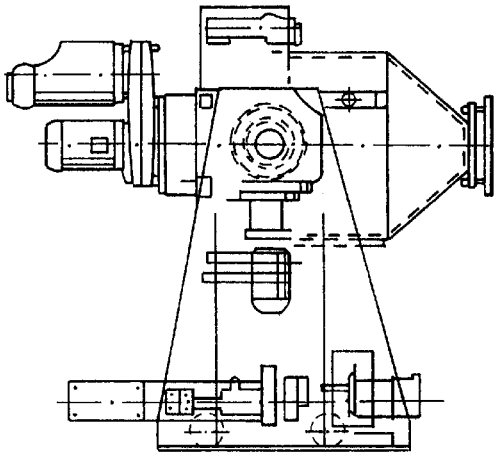
Figure 8C:
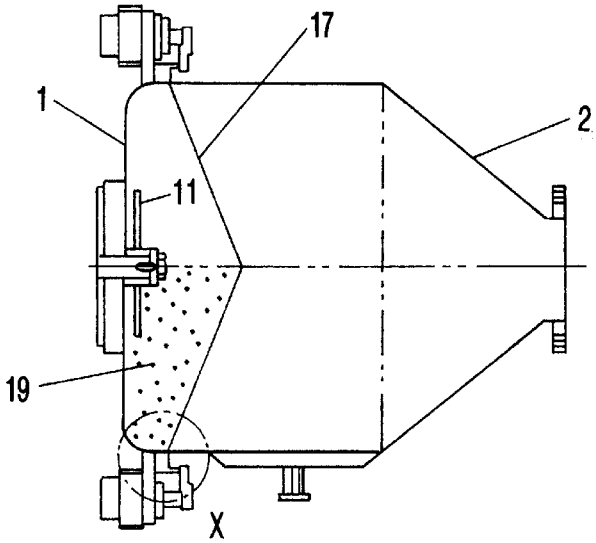
Figure 8D:
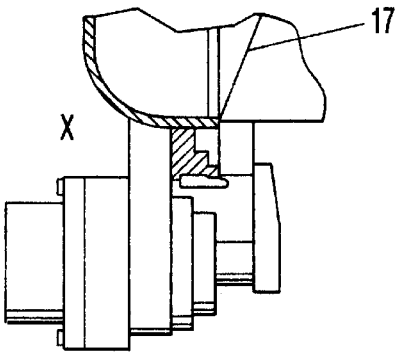

Furthermore, the contour of the forward or leading edge of the mixing blade 18 can be adapted to any specific application. FIG. 7 shows such a mixing or dispersion tool having crescent-shaped mixing blades 18 that at the forward or leading edge are continuously curved with a substantially uniform radius of curvatures.

Since a complete emptying of the first mixing container portion is impossible due to adhesion of particles at the mixing or dispersion tool and at the container wall, it is necessary to clean the mixing container portion when the composition of the material to be mixed or of the type of material to be mixed is changed. For this purpose, as shown in FIG. 8, a cone-shaped cover 17 is arranged between the two mixing container portions. At the outer circumference of the cover 17 an annular attachment is provided which, when fastening the second mixing container portion 2 at the first mixing container portion 1, is clamped between the respective connecting flanges of the two container portions 1, 2 and is fastened thereat by the clamping device 3.

In preparation of the mixing process, the second mixing container portion 2 which can travel, is filled with the material to be mixed in a position detached from the first mixing container portion 1 arranged at the support frame 8. Subsequently, the second mixing container portion 2 is centered below the first mixing container portion 1, lifted, and connected by the pneumatically actuated rotary clamping members 3 to the first mixing container portion 1.

Figure 2:
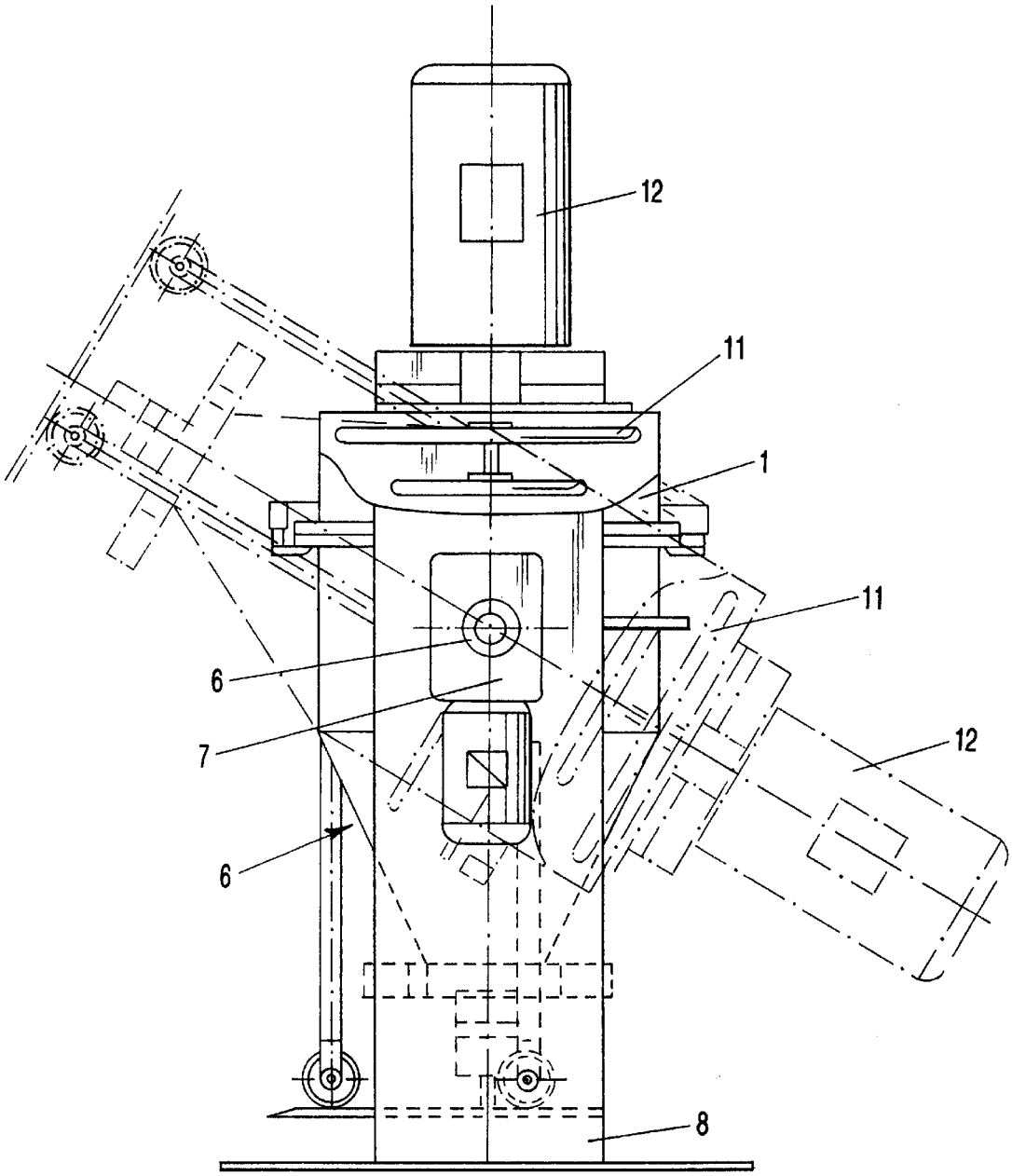
FIG. 2 shows a side view of the mixer rotated by 90° relative to FIG. 1, showing the preferred mixing position of the mixer.

For performing the mixing process, the mixing container 4 is moved by the pivot drive 7 into the mixing position, as shown, for example, in dashed lines FIG. 2.

In this position, the mixing container 4 is rotated When a mixing or dispersion tool 11 is used, the speed of the tool 11 in comparison to the mixing container 4 is selected to be relatively high. The slant of the mixing container 4 relative to the vertical position is determined by the separation of the material to be mixed in the upper portion of the inner container wall of the mixing container 4. It is selected to be such that the downwardly oriented flow of material to be mixed can reach the area of the mixing or dispersion tool 11.

Figure 3:
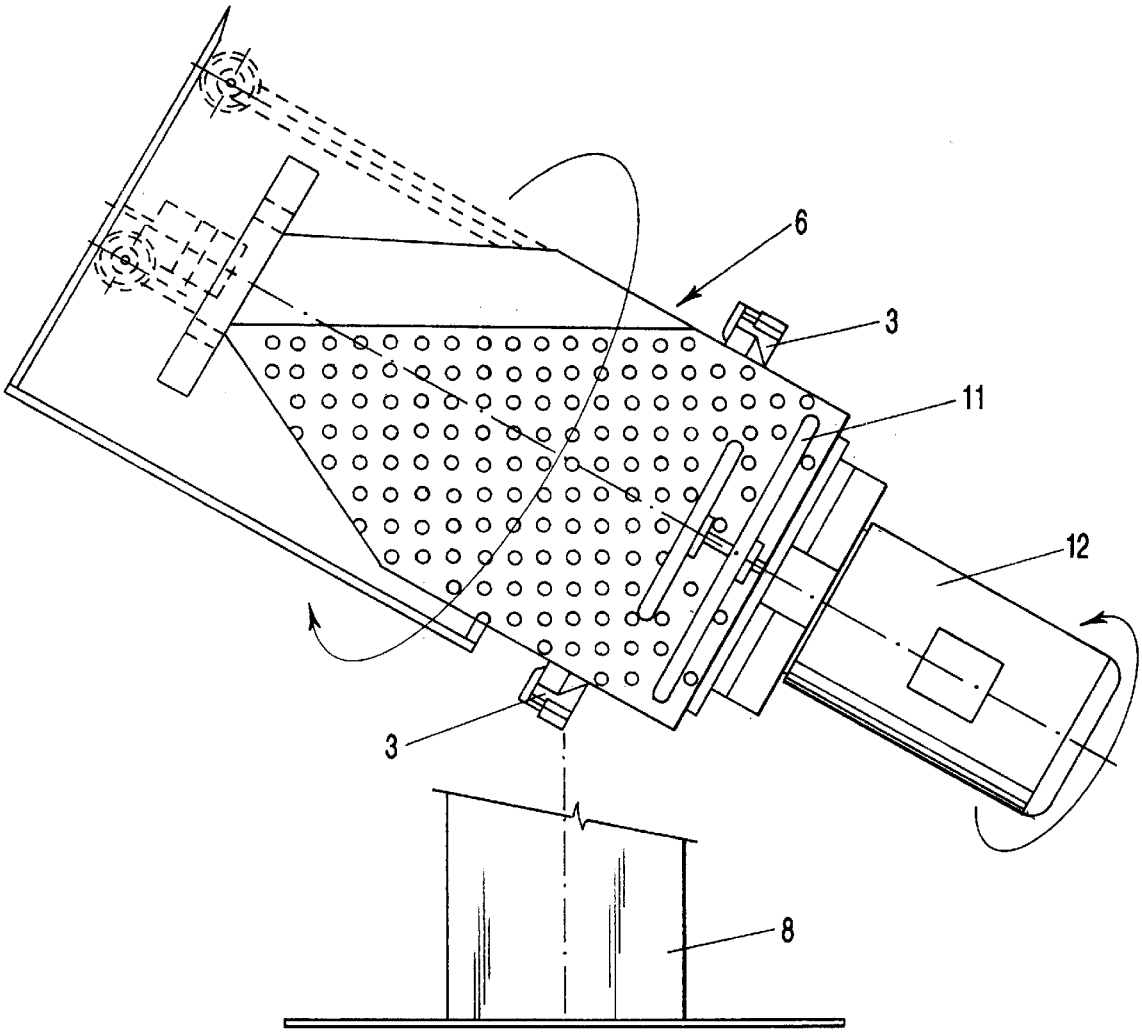
FIG. 3 shows a schematic representation of the mixer shown in the mixing position and containing material to be mixed.

In practice, a slant of the mixing container 4 relative to the vertical position by 10° to 70° has been proven to be expedient with respect to an excellent mixing of the material. When a mixing or dispersion tool 11 is used, for the aforementioned slant the speed of the mixing or dispersion tool 11 and of the mixing container 4 should be different by a factor of approximately 100 and the direction of rotation should be opposite (FIG. 3).

After completion of the mixing process, the container 4 is pivoted into its initial position in which is longitudinal axis coincides with the vertical position and the second mixing container portion 2 is the lower part of the mixing container 4. After separation of the mixing container portions 1 and 2, the second mixing container portion 2 can be moved to any desired location for emptying the mixed material.

The specification incorporates by reference the disclosure of German priority document 197 08 075.8-23 of Feb. 28, 1997.

The present invention is, of course, in no way restricted to the specific disclosure of the specification and drawings, but also encompasses any modifications within the scope of the appended claims.

What is claimed is:

1. A mixer for granular material, said mixer comprising:

a mixing container comprised of a first mixing container portion and a second mixing container portion detachably connected to one another;

said mixing container having a longitudinal axis and a transverse axis extending perpendicularly to said longitudinal axis;

a support frame in which said mixing container is supported so as to be pivotable about said transverse axis and rotatable about said longitudinal axis;

said mixing container having a first position in which mixing is performed and said second mixing container portion is positioned above said first mixing container portion;

said mixing container having a second position in which said second mixing container portion, after completion of mixing, contains the mixed material and is detachable from said first mixing container portion.

2. A mixer according to claim 1, further comprising:

a pivot bracket comprising a rotary bearing;

said mixing container supported by said rotary bearing in said pivot bracket for rotation about said longitudinal axis;

a shaft fixedly connected to said pivot bracket and rotatably supported in said support frame, wherein said mixing container is connected to said shaft.

3. A mixer according to claim 2, wherein said rotary bearing is a roller bearing.

4. A mixer according to claim 2, wherein said first mixing container portion has a rotating mixing tool comprising radially extending mixing blades, wherein said mixing blades end in direct vicinity of a container wall of said first mixing container portion.

5. A mixer according to claim 4, wherein said mixing blades, in a direction of rotation of said mixing tool, are downwardly and forwardly slanted at least in a radially outer portion of said mixing tool.

6. A mixer according to claim 2, wherein said first mixing container portion has a rotary mixing tool comprising mixing blades spaced from a container wall of said mixing container portion.

7. A mixer according to claim 6, wherein said mixing blades, in a direction of rotation of said mixing tool, are downwardly and forwardly slanted at least in a radially outer portion of said mixing tool.

8. A mixer according to claim 4, wherein said first mixing container portion comprises a cover closing off an interior of said first mixing container portion for introducing into said interior a granular cleaning substance.

9. A method for mixing granular materials, said method comprising the steps of:

providing a mixing container comprised of a first mixing container portion and a second mixing container portion detachably connected to one another, wherein said mixing container has a longitudinal axis and a transverse axis extending perpendicularly to said longitudinal axis;

supporting said mixing container on a support frame such that said mixing container is pivotable about said transverse axis and rotatable about said longitudinal axis;

filling a granular material into said second mixing container portion and connecting said second mixing container portion to said first mixing container portion;

pivoting said mixing container into a first position in which said longitudinal axis is slanted relative to a vertical position and in which said second mixing container portion is positioned above said first mixing container portion;

rotating said mixing container positioned in said first position for mixing the granular material;

after completion of mixing, positioning said mixing container in a second position such that said second container portion contains the mixed material and detaching said second mixing container portion from said first mixing container portion.

10. A method for mixing granular materials, said method comprising the steps of:

providing a mixing container comprised of a first mixing container portion and a second mixing container portion detachably connected to one another, wherein said mixing container has a longitudinal axis and a transverse axis extending perpendicularly to said longitudinal axis;

equipping said first mixing container portion with a mixing tool comprising radially extending mixing blades ending in direct vicinity of a container wall of said mixing container;

supporting said mixing container on a support frame such that said mixing container is pivotable about said transverse axis and rotatable about said longitudinal axis;

filling a granular material into said second mixing container portion and connecting said second mixing container portion to said first mixing container portion;

pivoting said mixing container into a first position in which said longitudinal axis is vertical and in which said second mixing container portion is positioned above said first mixing container portion;

rotating said mixing container positioned in said first position and said mixing tool for mixing the granular material;

after completion of mixing, positioning said mixing container in a second position such that said second mixing container portion contains the mixed material and detaching said second mixing container portion from said first mixing container portion.

11. A method according to claim 10, wherein in said step of rotating said mixing container and said mixing tool are rotated in opposite directions.

12. A method according to claim 11, wherein said mixing tool is rotated at a higher speed than said mixing container.

* * * * *